United States Patent [19]

Neumann

[11] Patent Number: 4,528,893

[45] Date of Patent: Jul. 16, 1985

[54] POWERED SWIVEL CONNECTION FOR TURNING HANGING LOADS ABOUT AN UPRIGHT AXIS

[75] Inventor: Gunther Neumann, Affalterbach, Fed. Rep. of Germany

[73] Assignee: Heinz Thumm Oelhydraulische Antriebe GmbH, Fellbach, Fed. Rep. of Germany

[21] Appl. No.: 347,644

[22] Filed: Feb. 10, 1982

[30] Foreign Application Priority Data

Feb. 13, 1981 [DE] Fed. Rep. of Germany ..... 3105193

[51] Int. Cl.[3] ..... F01L 33/02; F01B 1/06

[52] U.S. Cl. ..... 91/492; 91/180; 414/624

[58] Field of Search ..... 91/180, 492, 491, 503; 414/739, 624, 625

[56] References Cited

U.S. PATENT DOCUMENTS 3,899,958 8/1975 Spencer ..... 91/492

4,009,643 3/1977 Thumm ..... 414/739

*Primary Examiner*—Paul E. Maslousky

*Attorney, Agent, or Firm*—Marianne Rich

[57] ABSTRACT

A hydraulic motor either of the radial or axial piston type is used for swivelling a hanging load about an upright axis. The motor has a distributor for controlling the flow of hydraulic fluid to the input and drain ducts of the motor. The motor further has hydraulic ducts extending from the stator to the rotor for transmitting fluid required for operation of the actuator of a gripping device or bucket. The distributor floats, so that radial and axial play as well as deformation of the rotor relative to the stator may be taken up without stress. At least some of the hydraulic ducts pass through the distributor, connections being made by suitable rotary transmissions and connecting points within the motor.

18 Claims, 6 Drawing Figures

POWERED SWIVEL CONNECTION FOR TURNING HANGING LOADS ABOUT AN UPRIGHT AXIS

BACKGROUND OF THE INVENTION

The present invention relates to a power driven swivel connection for turning hanging loads about an upright axis, having a rotor joined by axial and radial bearings with a stator, at least one hydraulic duct running from the stator into the rotor by way of a rotary connection and a driving unit for acting on and turning the rotor in relation to the stator. The driving unit is made up of a collar on the stator or rotor with radial or axial cylinders therein having hydraulic cam drivers extending past a radial or (as the case may be) an axial face of the collar for driving against cams of a cam box on the stator (if the collar is joined with the rotor) or otherwise on the rotor. For timed distribution of hydraulic liquid to the cylinders so that the drivers are only pushed against such cam parts that the resultant is in the desired direction of swivel, a ported distribution spool is liquid-tightly seated within the collar for forcing liquid into the cylinders and letting it off in turn. The hydraulic ducts running from the stator to the rotor are, for example, for connection with the actuator of a clam-shell bucket. The pressure-tight rotary connections are needed for stopping tangling of hoses on swivelling the load. As noted, the driving unit may be a radial or an axial piston motor, while the cam box may be the rotor or the stator.

A swivel connection with a radial piston motor has been put forward in the prior art (see German Pat. No. 2,338,736) having two rotary joints running through the interface of a radial plain bearing, the interface being between a neck of the stator and the rotor. The rotor is furthermore supported by way of an axial rolling element bearing on a shoulder of the collar or cylinder drum of the motor. At the lower end of the hydraulic motor there are furthermore, in the space between the collar and the cam box, two washers acting as plain bearings in the case of a hanging load, and as thrust bearings when the bucket is pressed against the earth etc. When put into general use, this bearing system has, however, not given the desired effects, and specially on supporting or digging heavy loads, more specially when the bucket was acted upon by axial and radial blows, parts of the stator near the radial plain bearing were frequently broken and damaged. A further point is that the bearing gap with the rotary connections therein is open at one end on the outer side of the motor where full sealing is not possible so that there are losses of hydraulic liquid, this being responsible for the building up of dirt coatings on the housing and nearby parts and structures. Because the rotor connections or ports are generally high up on the motor housing, the hoses joined up at this position and running to the bucket are more likely to be damaged than if they were placed lower down. A further shortcoming is the generally great overall height and the great weight, caused thereby, of the swivel connection.

In the case of a further swivel connection designed on the same lines and whose cam box is constitutes the stator and whose collar is constitutes the rotor, the timing or distribution spool being locked on the stator (see German Offenlegungsschrift specification No. 2,838,428), the hydraulic ducts for operation of the bucket are by way of axial holes through the distribution spool from the stator to the rotor. The rotary connections are, in this case, at the lower part of a cylindrical interface between the distribution spool and the rotor. Because of the stiff connection between the distribution spool and the stator, there are, it is true, no sealing troubles at the connections of the hydraulic ducts between the distribution spool and the stator, but, however, for cutting down the forces acting on the distribution spool as a reaction to the effect of outside forces on the motor, it is necessary for complex bearings to be used to be generally free of play. Because, more specially, when working with heavy loads and blows, material is likely to be deformed, such deformation not being stopped by the bearings, the distribution spool and the parts, touching it, have a higher wear rate, this more specially being true on use with heavy loads.

GENERAL OVERVIEW OF THE INVENTION

One purpose of the present invention is that of improving the design of the known swivel connection discribed above, so that it may be used for heavy loads without any danger of being broken and with only a low degree of wear at the bearings and at the interfaces of the distribution spool, even for heavy loads, the connection nevertheless having a generally low overall height and, accordingly, a low weight.

For effecting this and further purposes, one suggestion of the present invention is a design in which the part of the hydraulic duct, running through the collar or cylinder drum, is joined by way of the rotary connection with the one end of a duct running through the distribution spool, the other end of the duct being joined at a connection point or junction with the part, running through the cam box, of the hydraulic duct, the connection point being sealed off for stopping hydraulic liquid making its way into the inside of the box, the sealing parts letting radial play take place between the distribution spool distributor and the rotor which is greater than the bearing play of the radial bearing. It is furthermore possible for the design to be such that the part, running through the collar or cylinder drum, of the hydraulic duct is joined up by way of the rotary connection with one end of such a duct running through the distribution spool, the other end of such duct being joined up at a connection point with the part, running through the cam box, of the hydraulic duct, there being two radial bearings which are placed on opposite sides of the cams and the cylinders. Further useful developments and forms of the invention will be seen from the dependent claims.

One important idea on which the present invention is based is that more specially the floating distribution spool which allows axial and radial play and furthermore bending of the rotor to take place in relation to the stator without itself being acted upon by forces, is more specially to be desired for work with heavy loads and heavy blows. In order, furthermore, to make certain of a low overall height, the hydraulic ducts for the connection with the bucket have to be designed running through the distribution spool from the stator to the rotor. Correspondingly, the rotary connections for of the hydraulic ducts may be placed inside the cam box so that there is now generally no danger of leakage to the outside. An important point is that, at the connection points at which the hydraulic ducts make their way from the distribution spool into the cam box, at least radial play has to be possible to a degree greater than the bearing play of the radial bearing, such play being sealed or bridged over by seals at this point. There may be axial play of the distribution spool at the collar and/or at the junctions with a cam box relative to the rotor.

As part of a preferred embodiment of the invention, the distribution spool has a central axial hole having a pipe with a smaller diameter running through it from end to end in the lengthwise direction. The pipe-like or ring cross-section duct between the inner face of the central hole and the outer face of the pipe, constitutes part of the hydraulic supply channel namely the rotary connections between the distribution spool and the collar. The pipe itself is joined up with the stator duct at its one end by way of a further rotary connection. At its other end there is a further junction, having gaskets, so as to give axial and radial play and producing a pipe connection to a duct in the rotor.

It is often desired to have more than two hydraulic ducts running through the stator into the rotor, as for example if in addition to operating the cam-shell bucket or grapple, further hydraulic functions are needed, for example when using a hydraulically powered saw on the bucket for sawing through a tree where it is gripped by the bucket. For such a gripper saw generally at least two further hydraulic ducts will be needed. While it is true that such further hydraulic ducts may be placed running through the distribution spool, the increase in diameter and weight, necessary for this, would be undesired. For this reason, one suggestion of the invention is for the further hydraulic ducts to be joined up outside the distribution spool by a direct rotary joint between the stator and the rotor. In this case, the radial plain bearings are best placed outside the interface with the rotary joints going through it, on opposite sides of the cams and the cylinders so that, at the interface, a small radial gap may be present to generally put to an end any danger of parts at this position being broken.

DESCRIPTION OF THE PREFERRED EMBODIMENTS

Figure 1:
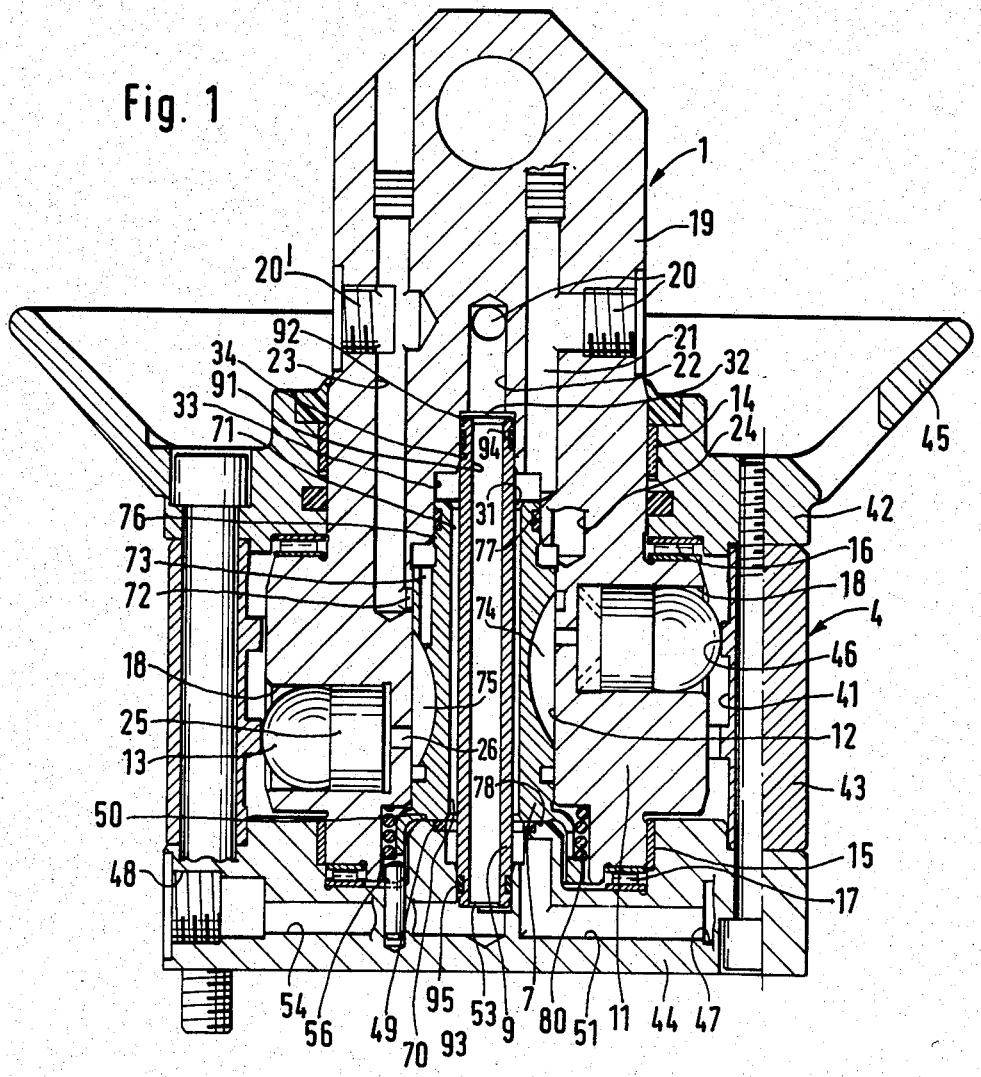
FIG. 1 is an vertical section through a first embodiment of a power driven swivel with two rotary connections.

The power driven swivel connections to be seen in the figures and constituting a hydraulic motor have, as their main parts, a stator 1, and a rotor 4 which may be turned relative to the stator about an upright axis. The a pot-like rotor 4 forms the cam box 41 of the hydraulic motor, while the stator 1 has, as part of it, a collar 11 or cylinder drum (placed within the cam box) of the hydraulic motor. The distribution or timing spool 7 is liquid-tightly placed in the middle hole 12 of the stator and is locked to the rotor 4 for turning therewith. Spool 7 has an axial hole 70 with a separate pipe 9 within it.

The cam box 41 may be generally said to be made up of three lathe-turned parts 42, 43 and 44, that is to say a top gray iron part 42 with an upwardly and outwardly turned hose guard skirt 45, a middle part 43 having within it the cams 46, acted upon by balls 13, of high quality steel, and a bottom part 44, having the threaded ports 47 and 48 for the hydraulic actuator of the bucket. The lower part 44 will generally be of different design on its outer side, dependent on the sort of bucket with which it is to be used so that its connection may be made with the connecting parts of the bucket. Rotor 4 is turningly supported on stator 1 by way of two radial plain bearings 14 and 15 and two axial or thrust rolling element bearings 16, 17, placed as far from each other as possible axially on the two sides of, that is to say under and over, the cams 46 and the cylinders 18.

Spaced round the neck 19 of the stator there are four threaded ports 20, 20' for hydraulic lines or hoses, hydraulic ducts 21, 22, 23, 24, running from such ports to the distribution spool 7 and, in the other case, the pipe 9 and then opening into hydraulic ducts 71, 91, 72 and 73. Duct 21 leads by way of rotary connection 31 into pipe-like (or ring cross-section) duct 71 and then past a junction 50 (which is sealed by seal 49 to stop losses of liquid into the inside of the cam box 41) to a duct 51 placed within the rotor 4 and extending to a threaded outlet port 47. For the rotor position shown in FIG. 1, port 20' may be an inlet port. Liquid then passes through duct 23, duct 72 into slot 74. On the exhaust side, liquid passes from slot 75 to duct 73, duct 24, and then to a drain duct. A further stator duct 22, after running through a rotary joint 32, is joined up with the duct 91 in pipe 9, such duct 91 opening at its other end by way of a further connection point 53 into rotor duct 54, the same, for its part, being joined with threaded hose outlet port 48.

The two further stator ducts 23 and 24 communicate with a number of slot-like ducts 74 and 75 which are formed by axial grooves (which are equally circumferentially spaced from each other) in the distribution spool 7 and the inner face of the hole 12 in stator 1 in which the distribution spool is liquid-tightly seated. The inlet and drain pipes, for hydraulic liquid placed outside the swivel connection, may be joined up with their threaded ports 20' on the neck of the stator.

Depending on the desired direction of rotation of the rotor, one of ports 20 and one of ports 20' is connected to the drain duct, while the other two are connected to the input duct of a hydraulic pump.

Within the collar 11 or cylinder drum, there are a number of circumferentially equally spaced radial pressure cylinders 18, each having within it a piston 25, whose outer end face comes up against a ball 13, extending outward radially from openings of the cylinders to a greater or lesser degree. The inner, back ends of pistons 25 are acted upon by hydraulic liquid, coming in by way of a hole 26 into the cylinder 18. Balls 13 have their parts which are furthest to the outside resting against cams 46, the cams being undulating so that they are at changing distances from the axis of the rotor. The cams are located on the inner face of the cam box 41. The radial positions of the pistons 25 are dependent all the time on the form of the cams 26.

If a ball 13 is pushed by way of its piston 25, acted upon by the hydraulic liquid with a given radial force against the inner face of the cam box 41, that is to say against the cam, there will be a greater or lesser resultant force or torque in the one or the other direction of turning, acting on the rotor, the resultant being dependent on the size and direction of the slope of the cam 46 at the given position of the ball 13. For getting turning motion of the rotor started, torques in the same direction have to be transmitted to the rotor 4 by way of the balls 13, acting on the cams. For this reason, only such cylinders 18 are to be put under pressure as have balls 13 running on a length of the cams 46 sloping outwards against the direction of turning. The balls 13 are forced outwards by the high pressure coming in through the input duct so that cam box 41 is turned, the balls then moving outwards against cam 46 till the balls get to the outer dead center positions. All those cylinders 18 whose balls 13 are running on lengths of cams 46 which, in the direction or turning have an inward slope, on the other hand have to be joined up with the drain duct which is at a low pressure so that these balls may be moved inwards without much force being needed by the cams running over them, this forcing the hydraulic liquid out of the cylinders 18 in question into the drain duct. When the balls get to their separate dead center positions or maxima and minima of the cams, the connections between the cylinders 18 with the input and drain ducts are cut off and, in each case, changed over on further motion of the cam box. This timed changeover in the connections so as to be in-phase with respect to the cams 46, with the input and drain ducts is caused by distribution spool 7 which is keyed to cam box 41 by way of a pin 56. Timing or distribution is by way of slot ducts 74 and 75 which, on turning of the distribution spool in relation to collar 11, are put in line with the different holes 26.

Distribution spool 7 has, at the rotary connection 31, an upwardly pointing cylinder part 76 seated in a cylindrical hole 33 in stator 1, in which it may be turned and moved axially to a certain degree. The rotary connection 31 is sealed by a gasket ring 77 placed in a peripheral groove of distribution spool 7 against liquid flow past this point in an outward or inward direction.

Near connection point 50 there are, at the end of the distribution spool 7 nearest the rotor 4, further gaskets or seals 49 and 49' which let radial and/or axial play, greater than the bearing play between the stator and the rotor take place, for stopping any overgreat forces, caused by blows against the outside of the structure on operation in a crane or excavator, from taking effect on the distribution spool. This is explained in greater detail below.

At the same time steps, however, have to be taken at connection point 50 to see that the pipe-like duct (duct of ring cross-section) 71 is sealed off to the necessary degree for stopping liquid from making its way into the inside of the cam box 41 and stopping any liquid flow in the opposite direction. In the figures, five possible different forms of such a connection point 50 will be seen, of which an account will now be given.

In the case of the embodiments to be seen in FIGS. 1 to 5, the distribution spool 7 has its end face 78 resting axially against an elastic gasket ring 49, placed in a ring-like cutout in the bottom part 44 of the rotor. The means retaining distributor 7 in this position differ for each of the embodiments.

Figure 2:
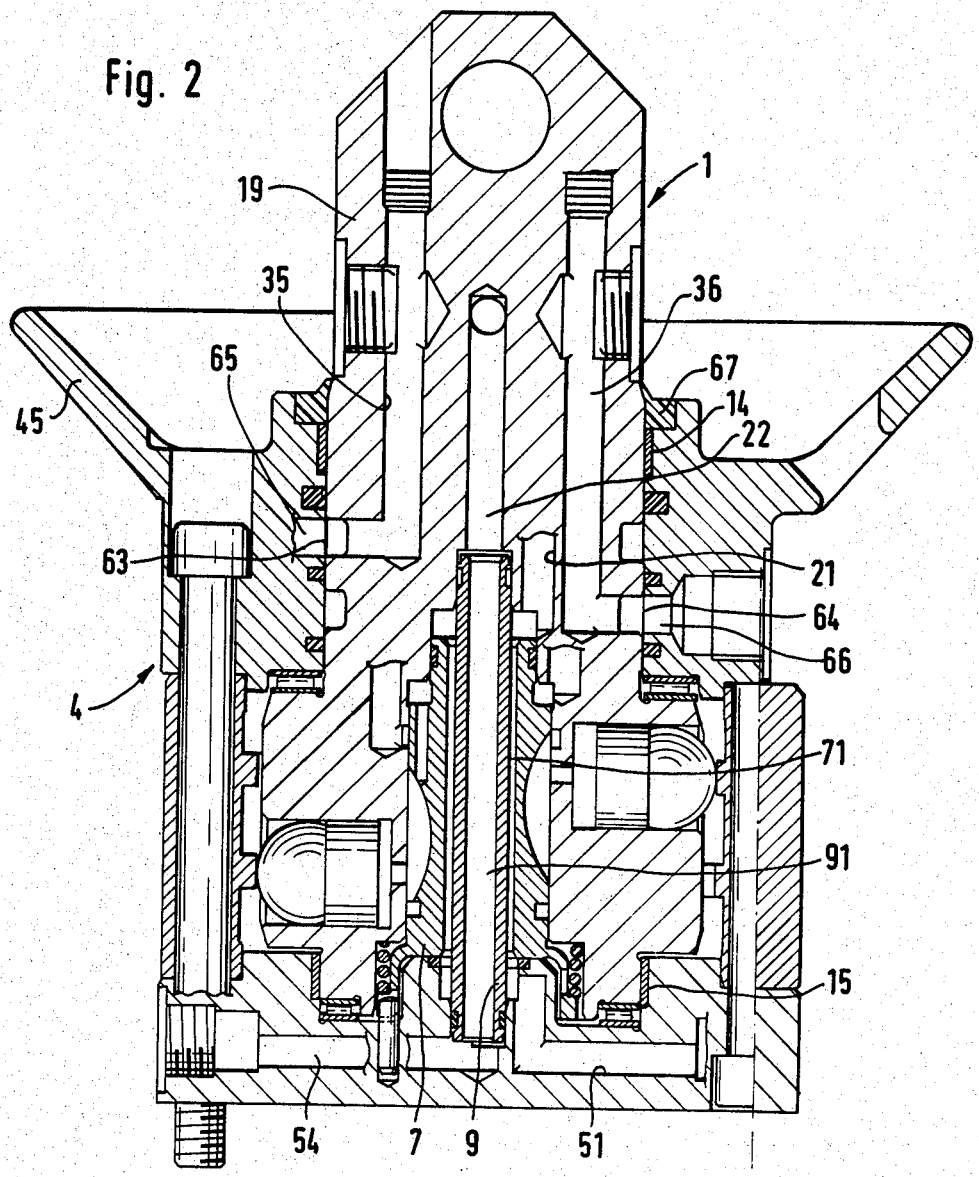
FIG. 2 is a view of a somewhat changed embodiment of the invention with four rotary connections.

In the embodiments to be seen in FIGS. 1 and 2, there is the compression spring 80, compressed axially, in a ring space between the stator and a skirt of the lower end of distribution spool 7, spring 80 forcing distribution spool 7 at connection point 50 springingly against axial gasket 49 and the rotor 4 at end face 78. On opposite axial forces coming into being, spring 80 is compressed so that there will be axial play of the distribution spool 7 not only in relation to stator 1, but furthermore with respect to rotor 4.

Figure 3:
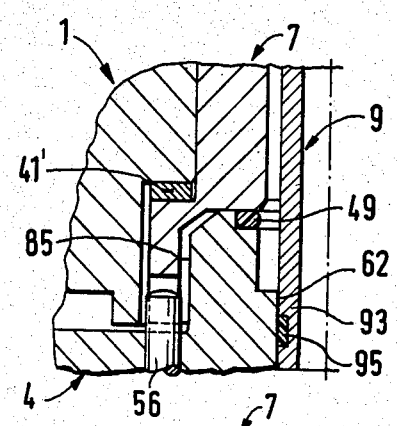
FIGS. 3 to 6 are views of four further possible embodiments of the design of the connection point between the distribution spool and the rotor, illustrated in vertical sections of the key parts of the system.

In the working example to be seen in FIG. 3, it will be seen that the spring in the gap between stator 1 and distributor 7 has been replaced by a shim 41'. Shim 41' limit axial play of distribution spool 7 in relation to the rotor 4 to an amount which may be taken up by elastic squeezing in a sideways direction of gasket ring 49, this stopping any undesired lifting of distribution spool 7 clear of gasket ring 9 which would make loss of liquid possible.

Figure 4:
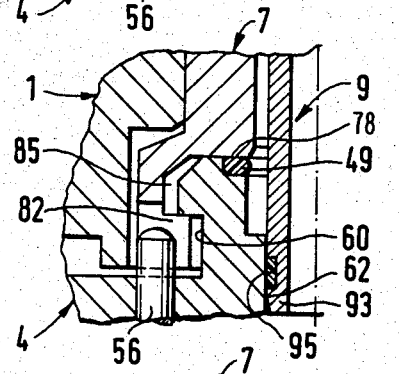
Figure 5:
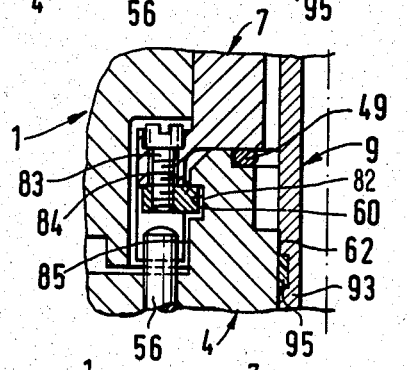

In the embodiment of FIGS. 4 and 5 there is a locking connection, acting in an axial direction, between distribution spool 7 and rotor 4, for stopping any axial gap coming into being at the ring gasket 49. In the embodiment of FIG. 4 the shoulder 82 which extends into the groove 60 in the radially outer face of a headpiece in the middle of the lower part of rotor 4 is rigidly connected to the distribution spool 7. In the case of the embodiment of FIG. 5, shoulder 84 takes the form of separate ring piece 84, fastened by screw 83 to the distribution spool, or in the form of a nut.

The radial ring gap 85 between the rotor 4 and distribution spool 7 gives, in all these working examples of the invention, the desired radial play between the said spool and the rotor.

Figure 6:
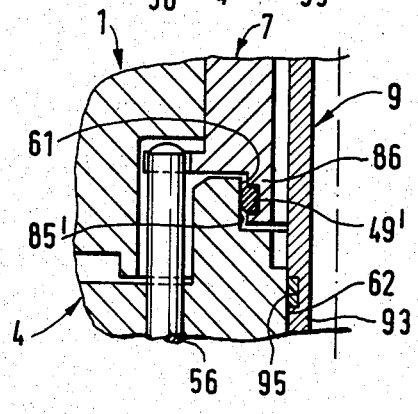

In the embodiment of FIG. 6, in place of the axially acting gasket 49 there is a radially acting one 49' bridging over the ring gap 85' between the skirt 86 at the lower end of distribution spool 7 and the inner face 61 of the headpiece on the lower part of rotor 4, this making radial and axial play possible.

The top end 92 of pipe 9, running through the hole 70 within the distribution spool 7, is seated in an axial hole 34 of stator 1, while its lower end 93 is taken up in an axial hole 62 of the rotor 4 with a certain amount of play (indicated by a thickening of line 62 in the drawing) so that a change in position of the rotor 4 in relation to the stator 1 in an axial and/or radial direction is not responsible for any great forces acting on pipe 9, which is simply moved out of the way. At the two ends, pipe 9 is sealed by elastic gasket rings 94, 95 seated in ring grooves on the outside of pipe 9. Dependent on the amount of friction at the top and lower ends of pipe 9 where it is seated in holes 34 and 62, pipe 9 will be turned in relation to the rotor 4 and/or the stator 1 when the rotor is power-turned, so that the two pipe connections may form a rotary connection (32) or a junction (53), that is to say a simple joint without turning of the two parts in relation to each other.

In the embodiment of FIG. 2, in addition to the hydraulic ducts 21, 71, 51; 22, 91, 54, running through from the stator 1 by way of distribution spool 7 and pipe 9 to the rotor, there are two further hydraulic ducts 35, 65; 36, 66 running from the stator into the rotor, their rotary connections 63 and 64 being in the neck part 19 of the stator 1 at a simple interface between stator 1 and rotor 4. Here as well there is a top and a lower radial plain bearing 14, 15 so that at the interface itself with the rotary connections running therethrough, there is no friction. In an upward direction the bearing gap is gasketed with the help of a special-purpose seal or gasket 67, taking effect between rotor 4 and stator 1, for stopping liquid from making its way through out of the part of the interface with the rotary joints 63, 64.

The embodiments of the invention to be seen in the figure are all in the form of powered swivel connections whose collars are made part of the stator and whose cam boxes are made part of the rotor. However, as a general teaching of the present invention, the parts might be placed the other way round, that is to say so that the collar would be joined to the rotor and the cam box would be joined with the stator while there would nevertheless be a floating distribution spool with radial and, if desired, axial play. In such a system, not shown herein, the input and drain ducts would have to be designed running from ports on the cam box to connection points and then to the distribution spool and from the same to the collar. At the connection points between the cam box and the distribution spool it will be necessary to have one gasket in each case for bridging over the play, that is to say the radial and possibly axial play (in addition thereto) as desired.

I claim:

1. Apparatus for turning hanging loads including at least one hydraulically controlled mechanism about an upright axis, comprising a first motor member having a plurality of peripheral hydraulic cylinders, and hydraulically controlled cam following means in each of said hydraulic cylinders;

second motor member means comprising a cam box having a cam face positioned relative to said first motor member for engaging said cam following means so that said first motor member and said second motor member means rotate relative to one another;

bearing means having predetermined radial play for coupling said first motor member to said second motor member means;

distributor means connected to said cam box for controlling fluid flow in said hydraulic cylinders; and a hydraulic supply channel for said hydraulically controlled mechanism, said hydraulic supply channel comprising a first duct passing through said first motor member, a distributor duct passing through said distributor means, rotary connection means connecting said first duct to said distributor duct, a cam box duct passing through said cam box, and a distributor-cam box junction connecting said distributor duct to said cam box duct; and means for sealing said distributor-cam box junction to prevent entrance of fluid into said cam box, said sealing means permitting a second radial play between said distributor means and said second motor member means, said second radial play exceeding said predetermined radial play.

2. Apparatus as set forth in claim 1, wherein said sealing means further permit predetermined axial play between said distributor means and said cam box.

3. Apparatus as set forth in claim 2, wherein said distributor means has an axial bore having an inner surface;

further comprising a pipe having an outer surface passing through said axial bore, thereby creating a ring-shaped duct between said inner and said outer surfaces, said ring-shaped duct constituting said distributor duct.

4. Apparatus as set forth in claim 2, wherein said first motor member has a collar containing said plurality of hydraulic cylinders, and a central hole; and wherein said distributor means is mounted in said central hole with axial play in the region of said rotary connection means.

5. Apparatus as set forth in claim 1, wherein said first motor member means comprises a collar having said hydraulic cylinders, and a central hole;

wherein said bearing means further permit a predetermined axial play between said second motor member means and said first motor member; and wherein said distributor means is mounted in said central bore and within said collar with axial play in the region of said rotary connection means, and abuts said cam box or said sealing means substantially without axial play.

6. Apparatus as set forth in claim 1, wherein said cam box has an axial bore;

wherein said distributor means has an axial skirt extending with radial and axial play into said axial bore of said cam box, thereby forming a ring-shaped gap; and wherein said sealing means comprises elastic gasket means in said ring-shaped gap.

7. Apparatus as set forth in claim 1, wherein said bearing means comprises a first and second radial bearing arranged on mutually opposite sides of said cam box and said cylinders.

8. Apparatus as set forth in claim 7, wherein said first and second radial bearing are plain bearings.

9. Apparatus as set forth in claim 7, wherein said first and second radial bearing are arranged at approximately the height of said rotary connection and the height of said junction, respectively.

10. Apparatus as set forth in claim 7, further comprising a first and second axial bearing, respectively arranged in the vicinity of said first and second radial bearing.

11. Apparatus as set forth in claim 10, wherein said cam box comprises a top part of grey iron and having said second axial and said second radial bearing, a middle part of high quality steel and comprising said cam face, a bottom part of grey iron and comprising said distributor-cam box junction and said first radial and said first axial bearing, and means for fastening said top to said middle and said middle to said bottom part.

12. Apparatus as set forth in claim 1, further comprising a second duct passing through said first motor member, a second motor member duct passing through said second motor member and rotary connection means connecting said second duct to said second motor member duct.

13. Apparatus as set forth in claim 12, wherein said first motor member and said second motor member means have a cylindrical interface; and wherein said bearing means comprises a first and second radial bearing located externally to said interface on opposite sides of said cam face and said cylinders.

14. Apparatus for turning hanging loads including at least one hydraulically controlled mechanism about an upright axis, comprising a first motor member having a plurality of peripheral hydraulic cylinders, and hydraulically controlled cam following means in each of said hydraulic cylinders;

second motor member means comprising a cam box having a cam face positioned relative to said first motor member for engaging said cam following means so that said first motor member and said second motor member means rotate relative to one another;

bearing means having predetermined axial play for coupling said first motor member to said second motor member means;

distributor means connected to said cam box for controlling fluid flow in said hydraulic cylinders;

a hydraulic supply channel for said hydraulically controlled mechanism, said hydraulic supply channel comprising a first duct passing through said first motor member, a distributor duct passing through said distributor means, rotary connection means connecting said first duct to said distributor duct, a cam box duct passing through said cam box, and a distributor-cam box junction connecting said distributor duct to said cam box duct; and means for sealing said distributor-cam box junction to prevent entrance of fluid into said cam box, said sealing means permitting a second axial play between said distributor means and said second motor member means, said second axial play exceeding said predetermined axial play.

15. Apparatus as set forth in claim 14, further comprising means for pressing said distributor means against said sealing means.

16. Apparatus as set forth in claim 15, wherein said first motor member is separated from said distributor means by an axial gap; and wherein said means pressing said distributor means against said sealing means comprises spacer means in said gap.

17. Apparatus as set forth in claim 16, wherein said spacer means comprises a spring.

18. Apparatus as set forth in claim 16, wherein said spacer means comprise a shim.

* * * * *